US006948225B2

(12) United States Patent
Smith

(10) Patent No.: US 6,948,225 B2
(45) Date of Patent: Sep. 27, 2005

(54) HYDROFORMED TUBULAR STRUCTURE AND METHOD OF MAKING SAME

(75) Inventor: Mark C. Smith, Troy, MI (US)

(73) Assignee: ArvinMeritor Technology, Troy, MI (US)

( * ) Notice: Subject to any disclaimer, the term of this patent is extended or adjusted under 35 U.S.C. 154(b) by 0 days.

(21) Appl. No.: 10/349,586

(22) Filed: Jan. 23, 2003

(65) Prior Publication Data

US 2004/0146340 A1 Jul. 29, 2004

(51) Int. Cl.[7] ..... B23P 17/00

(52) U.S. Cl. ..... 29/421.1; 29/505; 29/507; 29/283.5; 403/282; 72/54

(58) Field of Search ..... 29/419.1, 421.1, 29/505, 506, 507, 508, 516, 283.5, 509; 72/54, 56, 58, 60, 61, 62; 403/277, 282

(56) References Cited

U.S. PATENT DOCUMENTS

RE30,802 E * 11/1981 Rogers, Jr. ..... 29/421.1
4,759,111 A * 7/1988 Cudini ..... 29/523
4,761,870 A * 8/1988 Urano ..... 29/421.1
4,875,270 A * 10/1989 Krips et al. ..... 29/421.1
6,047,457 A * 4/2000 Bitto et al. ..... 29/516
6,276,740 B1 * 8/2001 Mellor et al. ..... 296/72
6,484,384 B1 * 11/2002 Gibson et al. ..... 29/516

* cited by examiner

*Primary Examiner*—Jermie E. Cozart
(74) *Attorney, Agent, or Firm*—Carlson, Gaskey & Olds

(57) ABSTRACT

A method and apparatus is provided for strengthening tubular members and attaching components to the tubular member using a hydroforming process. In one embodiment, the outer tube has a non-circular inner surface and the inner tube has an outer surface with a shape different than the non-circular inner surface. In another embodiment, the outer tube has an outer edge with a portion that is not perpendicular to the longitudinal axis of the inner tube. The outer edge prevents relative rotation between the tubes. The inner tube has a higher Young's modulus so that once the high pressure is removed the hydroforming process the inner tube will not contract as much as the outer tube.

8 Claims, 2 Drawing Sheets

HYDROFORMED TUBULAR STRUCTURE AND METHOD OF MAKING SAME

BACKGROUND OF THE INVENTION

This invention relates to a tubular structure, and more particularly, the invention relates to a hydroformed tubular structure suitable for use in manufacturing vehicle frames and suspensions.

Tubular structures are commonly used in the manufacture of vehicle frames and suspensions. To obtain the desired stiffness of the tubular member, either a thicker walled tube is used or reinforcing members are welded in the area needing stiffening. Occasionally, mass dampers are used for suspensions to dampen the suspension. The structure providing the mass is typically welded to the tubular member.

Welding is a costly process and difficult to control thereby resulting in poor welds. Frequently, the weld becomes an area of weakness and fails rendering the structure useless. It is desirable to utilize tubular members having as thin of a wall thickness as possible while providing localized stiffness in highly stressed areas without the use of welds. Furthermore, it is desirable to attach masses or other structures to the tubular member without the use of welds.

SUMMARY OF THE INVENTION AND ADVANTAGES

The present invention provides a method and apparatus for strengthening tubular members and attaching structures to the tubular members using a hydroforming process. The tubular structure includes an outer tube used to provide stiffness and attachment features for attaching components to the tubular member without the use of welds. The outer tube is placed over an inner tube and the tubular structure is placed into a die. A fluid, such as oil, is injected into the inner tube at high pressures to plastically deform the inner tube into engagement with a locating feature of the outer tube. In one embodiment, the outer tube has a non-circular inner surface and the inner tube has an outer surface with a shape different than the non-circular inner surface. Plastically deforming the inner tube during the hydroforming process laterally locks the tubes relative to one another while preventing relative rotation between the tubes. In a second embodiment, the outer tube has an outer edge with a portion that is not perpendicular to the longitudinal axis of the inner tube. The outer edge prevents relative rotation between the tubes. The outer tube of the second embodiment may be cut from a tube at the outer edge to form a plurality of outer tubes from a single tube assembly. Preferably, the inner tube has a higher Young's modulus so that once the high pressure is removed during the hydroforming process the inner tube will not contract as much as the outer tube.

Accordingly, the above invention provides a method and apparatus of reinforcing a tubular member without the use of welds.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1A:
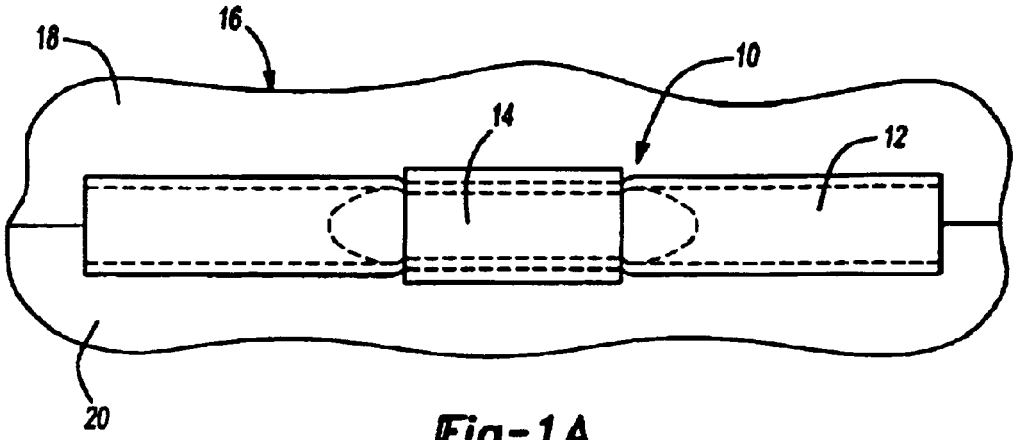
FIG. 1A is a first tubular structure produced by a hydroforming process.
Figure 1B:
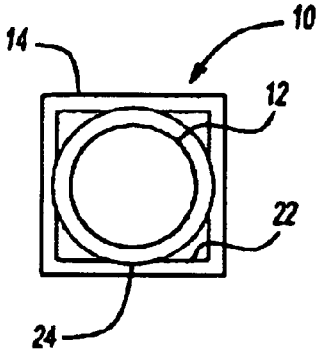
FIG. 1B is an end view of the tubular structure show in FIG. 1A.

One embodiment of the present invention tubular structure 10 is shown in FIGS. 1A and 1B. The tubular structure 10 is suitable for vehicle structures such as frames or suspensions. The tubular structure 10 includes an outer tube 14 arranged concentrically to an inner tube 12. The tubular structure 10 is formed in a die 16 between first 18 and second 20 die portions. A hydroforming process, as known in the art, is used to plastically deform the tubes 12 and 14 into a desired shape defined by the inner surface of the die 16. Highly pressurized fluid, such as oil, fills the inner cavity of the inner tube 12 to force the tubes 12 and 14 into engagement with the die surface.

The embodiment of the present invention shown in FIGS. 1A and 1B uses tubes that have overlapping interlocking portions of a non-circular shape to lock the tubes together against rotation. The outer tube 14 preferably includes a non-circular final deformed inner surface 22, such as a rectangular or square surface. The inner tube 12 has a final deformed outer surface 24 outboard of the outer tube 14 that is of a different shape than the non-circular inner surface 22 of the outer tube 14. Preferably, the outer surface 24 is circular for improved strength in the areas not reinforced by the outer tube 14. The outer surface 24 of the inner tube 12 is deformed into engagement with the square inner surface 22 of the outer tube 14 thereby locking the tubes 12 and 14 together against rotation relative to one another. The outer surface 24 of the inner tube 12 extends radially slightly beyond the inner surface 22 of the outer tube 14 thereby laterally locating the tubes 12 and 14 relative to one another.

In another aspect of the present invention, the inner 12 and outer 14 tubes may be of a different stiffness to better lock the tubes to one another. For example, the inner tube 12 may have a higher Young's modulus than the outer tube 14 so that once the pressure is removed during the hydroforming process the inner tube will relax less than the outer tube thereby shrinking the outer tube further onto the inner tube. This may be accomplished, for example by using titanium for the outer tube and steel for the inner tube.

Figure 2A:
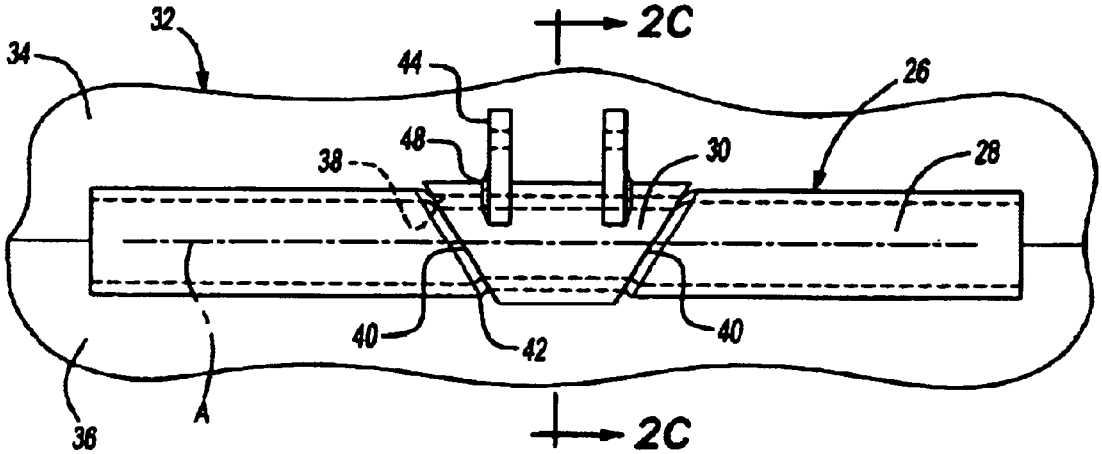
FIG. 2A is a second tubular structure produced by a hydroforming process.
Figure 2B:
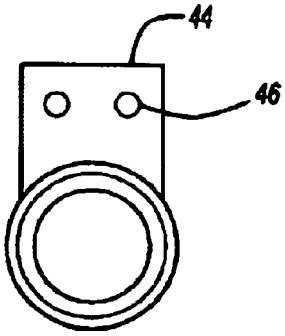
FIG. 2B is an end view of the tubular structure shown in FIG. 2A.
Figure 2C:
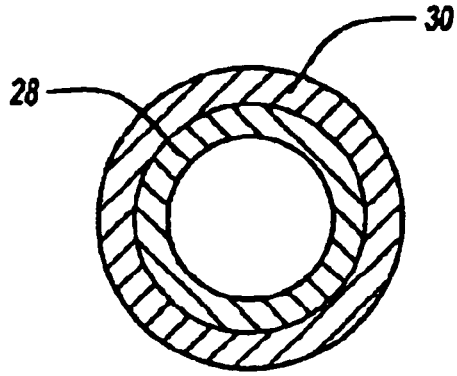
FIG. 2C is a cross-sectional view taken along lines 2C—2C of FIG. 2A.

Another tubular structure 26 is shown in FIGS. 2A–2C. The tubular structure 26 includes an inner tube 28 and an outer tube 30 arranged concentrically over the inner tube 28. The structure 26 is placed in a die 32 having first 34 and second 36 die portions defining a desired shape for the hydroformed structure 26.

The structure 26 has a longitudinal axis A where the tubes 28, 30 overlap one another. However, it is to be understood that the structure 26 may have numerous bends that may not be arranged concentrically along the longitudinal axis A over the entire length of the structure 26. The outer tube 30 includes an inner surface 38 and an outer edge 40 transverse to the axis A. A portion of the outer edge 40 is non-perpendicular to the axis A. Said another way, the outer edge 40 is non-perpendicular to the length of the inner surface 38. The outer surface 42 of the inner tube 28 is plastically deformed into engagement with the inner surface 38 of the outer tube 30. The inner tube 28 is deformed into engagement with the edge 40 of the outer tube thereby laterally and rotationally interlocking the tubes 28 and 30 to one another.

Figure 3:
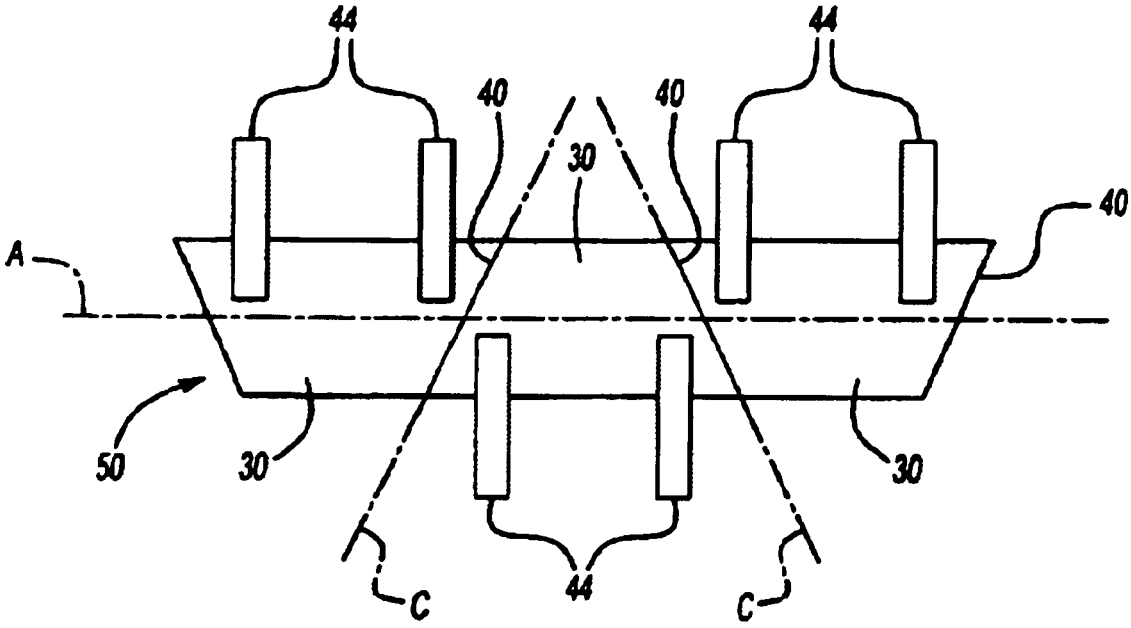
FIG. 3 is an elevational view of an outer tube assembly from which numerous outer tubes may be cut similar to the outer tube shown in FIG. 2A.

The outer tubes 14 and 30 may be used to locally stiffen the inner tubes 12 and 28 to provide mass damping, or provide an attachment location. For example, the outer tube 30 shown in FIGS. 2A and 2B, may include a flange 44 providing mounting features 46 such as holes. The flange 44 may be secured to the outer tube 30 by weld beads 48. As shown in FIG. 3, to provide efficient manufacturing of the tubular structure 26, a plurality of outer tubes 30 may be cut from an outer tube assembly or blank 50, as shown in FIG. 3. The outer tubes 30 may be cut along lines C to provide the outer edge 40. It is to be understood that the outer edge may not be a surface defined by a single plane as shown, but rather the outer edge 40 merely needs to include an irregular shape sufficiently sized to receive a deformed portion of the inner tube 28 to lock the tubes to one another.

It should be understood that the inner 12 and outer 14 tubes may have any initial cross-sectional shape prior to hydroforming. It should further be understood that the tubes 12 and 14 may be plastically deformed into any cross-sectional shape during the hydroforming process.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A method of hydroforming a tubular structure comprising the steps of;

a) placing an outer tube over an inner tube, the outer tube extending between a first and second end, and the inner tube extending beyond the outer tube at each of the first and second ends;

b) hydroforming the inner tube by plastically deforming the inner tube into engagement with the outer tube;

c) rotationally and axially locking the inner and outer tubes together with an interlocking feature formed during step b); and d) the interlocking feature being formed by at least one irregular edge of the outer tube, the at least one irregular edge defining a plane which is non-normal to a longitudinal axis of a segment of the tubular structure.

2. The method as set forth in claim 1, wherein the outer tube extends along a central axis, and the inner tube extend along a central axis, the central axes being coaxial, and the interlocking feature being formed by the irregular edge, and with the central axes passing through the plane.

3. The method as set forth in claim 2, wherein there are irregular edges at each of the first and second ends of the outer tube, the irregular edges in combination with the inner tube rotationally and axially locking the outer tube on said inner tube.

4. The method as set forth in claim 3, wherein each of the irregular edges define planes that are non-normal to the central axes, and with the central axes passing through each of the planes.

5. The method as set forth in claim 4, including forming a blank having a plurality of outer tube portions, cutting the blank at intermediate locations to form the irregular edges such that the blank is cut into a plurality of outer tube portions, with one of the plurality of outer tube portions then being utilized in step (a).

6. A method of hydroforming a tubular structure comprising the steps of;

a) placing an outer tube over an inner tube wherein the outer tube has a first end and a second end with the inner tube extending axially beyond the outer tube at each of the first and second ends;

b) hydroforming the inner tube by plastically deforming the inner tube into engagement with the outer tube; and c) rotationally and axially locking the inner and outer tubes together with an interlocking feature formed during step b) wherein the interlocking feature is formed by a first edge surface at the first end of the outer tube and a second edge surface at the second end of the outer tube wherein the first and second edge surfaces are non-parallel.

7. The method as set forth in claim 6 wherein the outer and inner tube define a central axis that longitudinally along at least a portion of a length of the tubular structure and including forming the first and second edge surfaces to extend at oblique angles relative to the center axis.

8. The method asset forth in claim 6 including extending the first and second edge surfaces three-hundred and sixty degrees about the central axis.

* * * * *